United States Patent [19]

Pistien

[11] Patent Number: 4,518,346

[45] Date of Patent: May 21, 1985

[54] GAS FUEL BURNER WITH INCORPORATED IGNITION AND SAFETY DEVICES

[75] Inventor: Jacques F. Pistien, L'ile-st-Denis, France

[73] Assignee: Gaz de France, Paris, France

[21] Appl. No.: 601,933

[22] Filed: Apr. 19, 1984

[30] Foreign Application Priority Data

Apr. 29, 1983 [FR] France ..... 83 07170

[51] Int. Cl.[3] ..... F23Q 3/00

[52] U.S. Cl. ..... 431/266; 431/288; 126/39 H

[58] Field of Search ..... 431/264, 266, 257, 288; 126/39 E, 39 BA, 39 H

[56] References Cited

FOREIGN PATENT DOCUMENTS 2062094 6/1971 France .
1032381 6/1966 United Kingdom .
1348245 3/1974 United Kingdom .
1443553 7/1976 United Kingdom .
1543618 4/1979 United Kingdom .

*Primary Examiner*—Carroll B. Dority, Jr.
*Attorney, Agent, or Firm*—Martin P. Hoffman; Karen M. Gerken; Mitchell B. Wasson

[57] ABSTRACT

The invention relates to a gas fuel burner with incorporated ignition and safety systems, wherein the burner body defines a central shaft, co-axial to the distribution chamber, situated under the cap and opening at the lower part of the burner to allow admission of secondary air; radial grooves opening at least locally in the distribution chamber are formed in the upper part of the burner body situated under the cap, the ignition electrode and safety element being placed inside the central shaft under the protective cap.

The invention finds an application in burners for use in extra-flat cooking apparatus.

11 Claims, 6 Drawing Figures

GAS FUEL BURNER WITH INCORPORATED IGNITION AND SAFETY DEVICES

The present invention relates in general to gas burners, such as for use in cooking apparatus, equipped with ignition and flame extinction safety means.

The invention relates more particularly to a gas burner with incorporated ignition and safety devices, with main flame and a pilot flame to stabilize said main flame, of the type comprising: a burner body which defines an annular distribution chamber receiving the primary air-gas fuel mixture, main paths being provided in said burner to supply the main flame with fuel mixture from said chamber and auxiliary paths being likewise provided in the burner body to supply the pilot flame with fuel mixture from said chamber, at least one igniting electrode, one safety element, and a protective cap mounted on the burner body.

Ignition of the burners may be electrical by means of sparks ignited by an ignition electrode or spark plug, using an electronic or piezoelectric system.

The safety device may be constituted by either an expansion-working device (using metallic, liquid or vapor expansion), or a device producing an electromotive force, such as a thermocouple, or an electronic device using for example an ionization electrode.

All these different devices act either directly, namely without the supply of any external energy, or indirectly, namely with the supply of external energy where the gas fuel is admitted into the burner.

According to the known devices, ignition electrodes and safety elements are situated outside the burners, close to the flame outlets, on the axis thereof and at a definite distance therefrom.

The cleaning of burners equipped with such devices tends to alter somewhat the original position. A deterioration and clogging of the electrodes and safety elements often occurs through the cleaning materials used or through sudden overspillings of cooking foods. Consequently the ignition and safety devices are easily disturbed in their operation, if not rendered completely inoperative.

It is the object of the present invention to overcome the aforesaid disadvantages and to produce a burner giving adequate protection to the ignition and safety devices against risks of being damaged or put out of order.

This object is reached with a burner of the type defined hereinabove, wherein the burner body defines a central shaft, co-axial to the distribution chamber, situated under the cap and opening at the lower part of the burner to allow admission of secondary air; radial grooves opening at least locally in the distribution chamber are formed in the upper part of the burner body situated under the cap, the ignition electrode and safety element being placed inside the central shaft under the protective cap.

Because of the presence of a cap-topped central shaft, the ignition electrodes and safety elements are adequately protected against external aggressions.

The orifices and grooves provided in the upper part of the burner head permit ignition by electrode and safety by thermocouple from inside the burner, whilst preserving inter-ignition.

According to the invention, the radial grooves are formed in the burner body close to the ignition electrode and to the safety element.

Preferably, said ignition electrode and safety element are placed diametrically opposite the inside of the central shaft.

The grooves formed in the upper part of the burner body create a communication with the distribution chamber, owing to two orifices forming together an angle.

Said grooves formed in the upper part of the burner body widen out at the peripheral part of said body.

The width of said grooves is between about 1 and 4 mm.

The cap rests on the burner head via grooves defining radial paths between them.

Said radial paths provided between the grooves either have a constant width or are slightly narrower towards the periphery of the cap.

The height of the grooves is around at least 4 mm.

The particular design of the lower surface of the cap permits both a better diffusion of the calories absorbed whilst the burner is working and an increased aerating at flame level, this improving combustion.

The invention will be more readily understood on reading the following description with reference to the accompanying drawings, in which.

Figure 1:
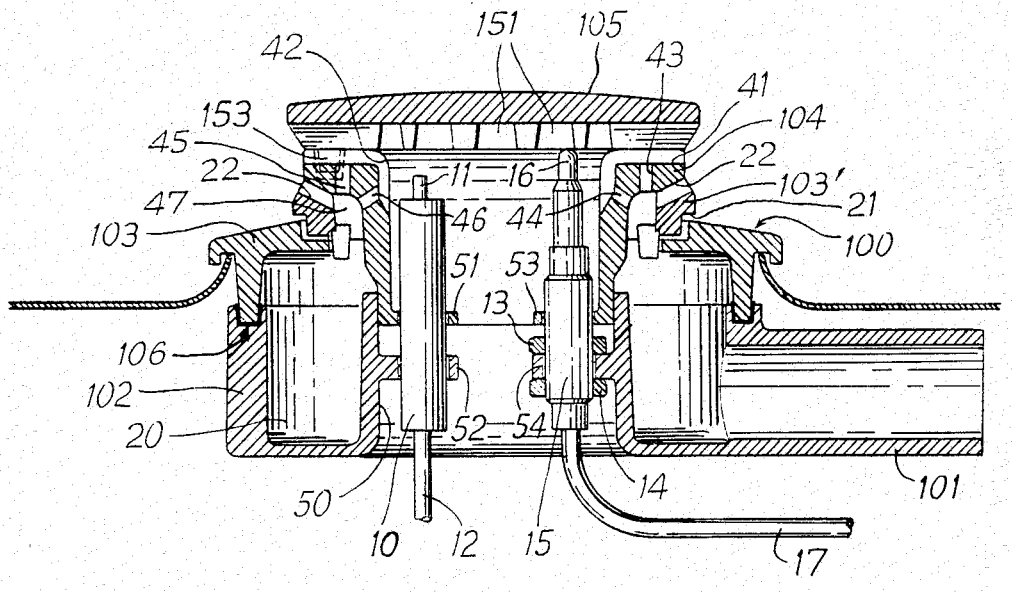
FIG. 1 is an axial section of a burner according to the invention.
Figure 2:
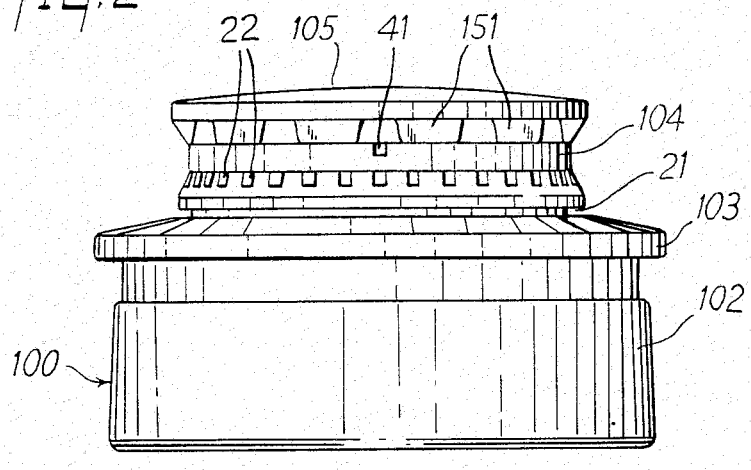
FIG. 2 is an elevational view of the burner shown in FIG. 1.

Referring first to FIGS. 1 and 2, these show the burner according to the invention with no ignition or safety device on the outside of burner body 100.

The actual burner body is made up of three main parts. One lower annular part 102 defining a distribution chamber 20 for the primary air/gas fuel mixture admitted through a side pipe 101 opening into said annular distribution chamber. The inner wall of said distribution chamber 20 defines a free space 50 issuing into the lower part of the burner whilst being isolated from the inside of chamber 20. An intermediate part 103 of the burner body 100, insulated from the lower annular part 102 by a heat insulating joint 106, and which can be made of a plurality of parts 103, 103', defines the outer upper wall of said chamber 20. The main flames and the pilot flame are supplied with fuel mixture from distribution chamber 20 via paths 22, 21 respectively provided in the intermediate part 103 of the burner. Annular path 21 supplying the pilot flame may be defined for example by two separate parts 103, 103' of the intermediate part of the burner whereas paths 22 supplying the main flames may be formed on the outer upper surface of upper part 103' of said intermediate part 103, 103'. Paths 22 are uniformly distributed over the whole periphery of the burner. Upper part 104 of burner body 100 which cooperates with intermediate part 103, 103' to define the main paths 22 supplying the main flames, has the shape of a cylindrical sleeve with a flange 107 (see FIG. 3). A protective cap 105 rests on the flange 107 of upper part 104 of the burner. According to the invention, a vertical central shaft 50 is provided inside the burner through the entire height thereof and is only closed at its upper part by cap 105. An electrode 10 and a safety element 15 are placed inside the central shaft 50 and secured on pairs of flanges 51, 52 and 53, 54 respectively. For every pair of flanges, one 53, 51 is fast with the upper part 104 of the burner body, the other 54, 52 is fast with the lower part 102 of said burner body. The safety element 15 secured on flange 54 by way of nuts 13, 14 has its active part (such as a thermocouple for example) situated immediately under cap 105 close to upper part 104. Likewise, electrode 10 has its active part 11 immediately beneath cap 105 close to upper part 104. In the illustrated embodiment, safety element 15 and electrode 10 are placed diametrically opposite the inside of cylindrical shaft 50 and are parallel to the axis of the burner. Electrode 10 and safety element 15 which go clean through flanges 51, 52 and 53, 54 respectively are connected via conductors 12, 17 respectively to the conventional electrical devices (not shown in the drawings) used for controlling the burner.

Figure 3:
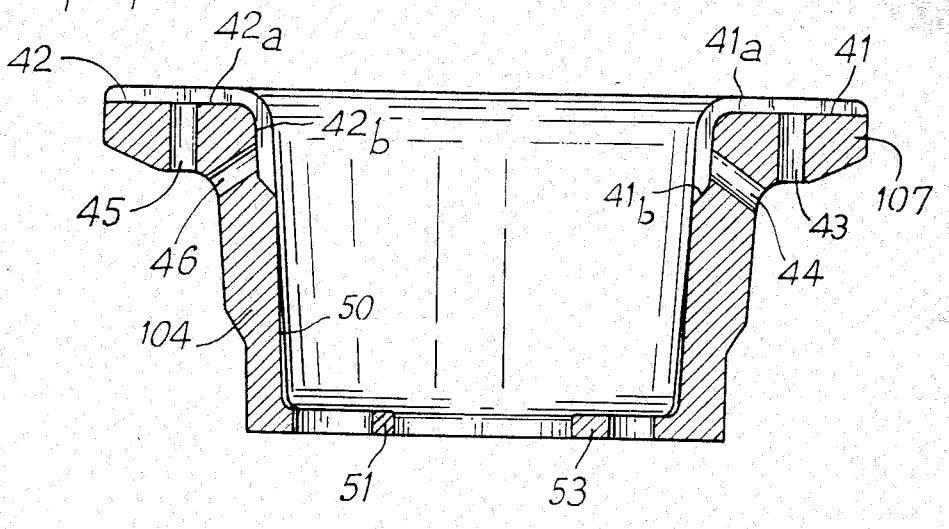
FIG. 3 is a cross-sectional view along line III—III of the burner body part shown in FIG 4.
Figure 4:
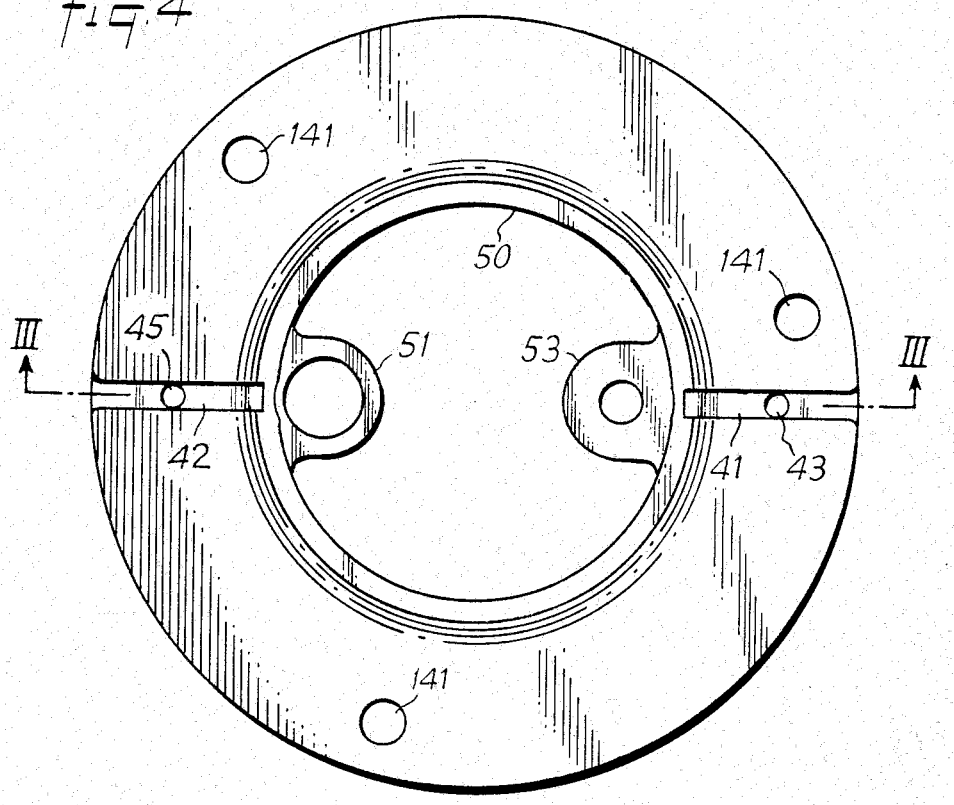
FIG. 4 is a plan view of a burner body according to the invention.

Referring more particularly to FIGS. 1, 3 and 4, the presence of grooves 41, 42 is observed in the upper face of upper part 104 of the burner body 100. Radial grooves 42, 41 are situated opposite the active parts 11, 16 of electrode 10 and safety element 15 respectively. In the illustrated example, grooves 41, 42 are situated along a diameter of flange 107. Each groove 41, 42 communicates via an orifice 43, 45 respectively, with the annular space 47 distributing the fuel mixture to the main paths 22 supplying the main flames. The object of orifices 43, 45 is to allow reciprocal ignition. Extra orifices 44, 46 whose axes form an angle of for example about 50° to 60° with the axis of the first orifices 43, 45 respectively, create a communication between the annular space 47 distributing the fuel mixture to the main paths 22, and vertical groove portions 41*b*, 42*b* extending the horizontal groove portions 41*a*, 42*a* of grooves 41, 42. Orifices 43, 45 also contribute to permitting reciprocal ignition.

Grooves 41, 42 may differ in design from those illustrated in the figures, but it is essential for each groove to communicate at least locally with the annular space 47 distributing the fuel mixture to the main paths 22. Each groove 41, 42 can for example, be wider at its upper part and extend into a narrow slot communicating with annular space 47. Advantageously, grooves 41, 42 will be widening out slightly where they issue into the periphery of the burner body.

By way of example, a groove 41, 42 such as illustrated in FIGS. 1, 3 and 4, can be between 2 and 2.5 mm wide, and 1.2 and 1.5 mm deep, whereas the diameter of orifices 43, 44, 45, 46 may be as much as the width of the grooves.

With a groove extended throughout its length by a slot it is possible to make, for example, over a depth of between 1.2 and 2 mm, a 3 mm-wide notch from the upper surface of the flange 107, and to make through the rest of the thickness of flange 107 a slot about 1 mm wide.

Figure 5:
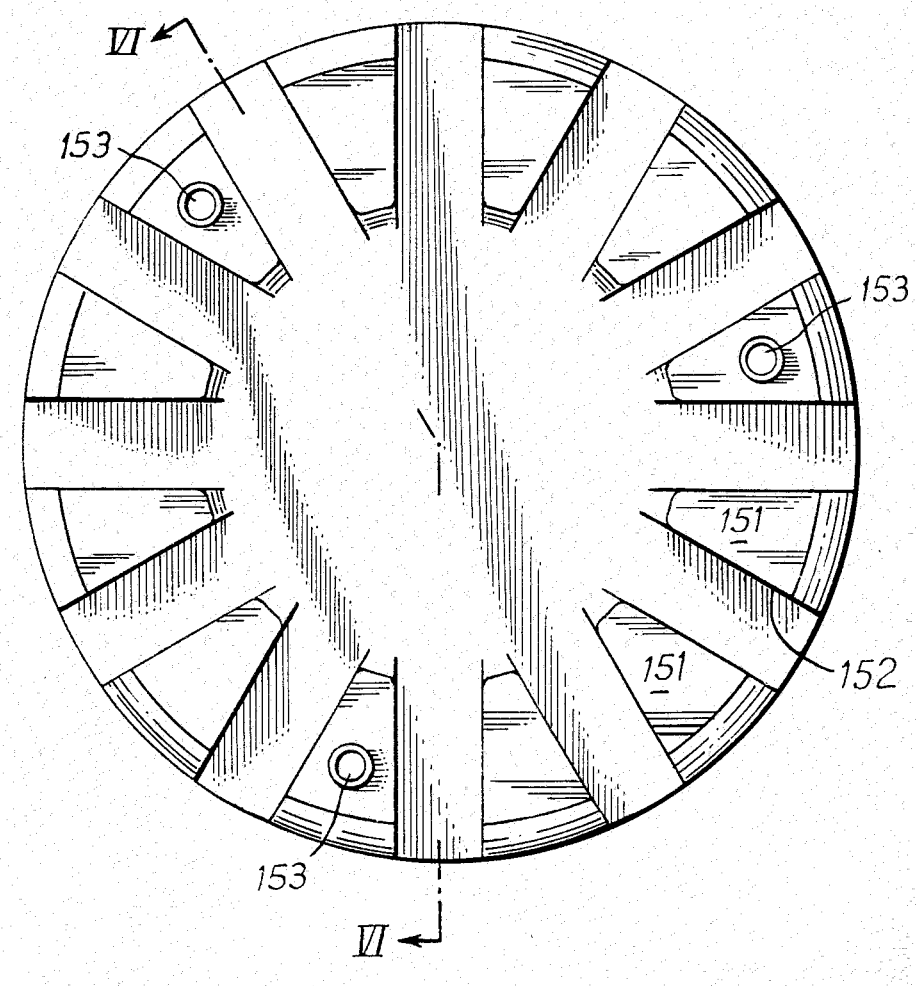
FIG. 5 is a view showing the lower face of a burner cap according to the invention.
Figure 6:
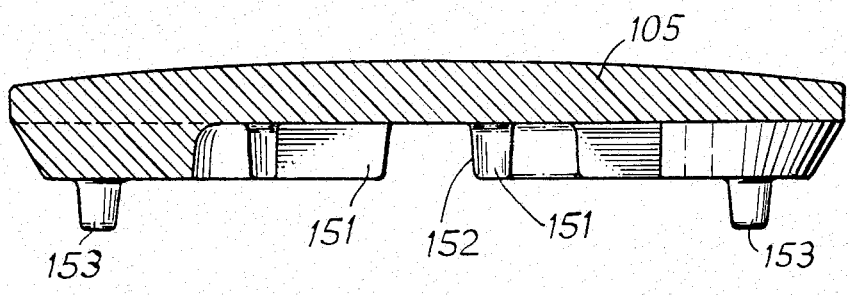
FIG. 6 is a cross-section along line VI—VI of FIG. 5.

Referring now to FIGS. 1, 5 and 6, these show that the protective cap 105 rests over the top part of the flange 107 of part 104 via flat ribs or projections 151 regularly distributed on the periphery of the lower face of cap 105. Radial paths 152 of width substantially constant or slightly increasing outwardly are provided between ribs 151. Said paths are provided to help the flow of secondary air and to aerate the flames whilst the lower surfaces of ribs 151 in contact with the burner head 104 contribute to diffusing the calories absorbed by the burner in operation. Ribs 151 may for example be 12 in number, regularly distributed on the peripheral part of the lower face of cap 105. Ribs 151 may be between 3 and 5 mm high. Studs 153, three studs for example, which are regularly distributed and define angles of 120° between to adjacent studs, are fast with the lower face of cap 105 and engaged in corresponding housings 141 (FIG. 4) provided in flange 107 of part 104 in order to correctly position the cap on the burner body 100.

As clearly shown in FIGS. 1 and 2, the diameter of cap 105 is equal to or slightly greater than that of the burner body 100 at the level of the pilot flame.

In general, the grooves 41, 42 and orifices 43 to 46 provided in the upper part 104 of the burner head are designed to allow ignition by electrode and safety by thermocouple from inside the burner. The diameter of orifices 43 to 46, their situation and the dimensional characteristics of grooves 41, 42 are adapted to permit inter-igniting and safety throughout a predetermined range of utilization of the burner between full flow and reduced flow. The parameters of these elements may thus be adapted to different conditions of operation. It will however be noted that in the illustrated example of embodiment, orifices 46, 44 are essential to keep up a residual flame around elements 10 and 15 and to permit reciprocal ignition through annular part 47 whereas orifices 45, 43 only play a secondary role.

The burner body such as described hereinabove is particularly easy to produce for example in aluminium. It is especially adaptable to extra-flat cooking apparatus and the electrodes and safety elements are particularly simple to fit.

What I claim is:

1. A burner for gas fuel with incorporated ignition and safety systems, of the type having a main flame and a pilot flame to stabilize said main flame, and comprising a burner body which defines an annular distribution chamber receiving the primary air-gas fuel mixture, main paths being provided in said burner to supply the main flame with fuel mixture from said chamber, and auxiliary paths being likewise provided in the burner body to supply the pilot flame with fuel mixture from said chamber, at least one igniting electrode, one safety element, and a protective cap mounted on the burner body, wherein the burner body defines a central shaft, co-axial to the distribution chamber, situated under the cap and opening at the lower part of the burner to allow admission of secondary air, radial grooves opening at least locally in the distribution chamber are formed in the upper part of the burner body situated under the cap, the ignition electrode and safety element being placed inside the central shaft under the protective cap, and orifices being formed through the central shaft and communicating with the distribution chamber for directing gas jets towards said ignition electrode and said safety element.

2. A burner as claimed in claim 1, wherein the radial paths are formed in the burner body close to the ignition electrode and safety element.

3. A burner as claimed in claim 1, wherein said ignition electrode and safety element are placed diametrically opposite the inside of the central shaft.

4. A burner as claimed in claim 1, wherein said ignition electrode and safety element are mounted on flanges of the burner body forming projections inside the central shaft.

5. A burner as claimed in claim 1, wherein certain of the grooves formed in the upper part of the burner body and in communication with the distribution chamber by way of orifices in the burner body.

6. A burner as claimed in claim 1, wherein said grooves formed in the upper part of the burner body widen out at the peripheral part of said body.

7. A burner as claimed in claim 1, wherein the grooves formed in the burner body have a width between about 1 and 4 mm.

8. A burner as claimed in claim 1, wherein the cap rests on the burner body via means forming radial grooves.

9. A burner as claimed in claim 8, wherein the radial grooves either have a constant width or are slightly narrower towards the periphery of the cap.

10. A burner as claimed in claim 8, wherein the height of the grooves is around at least 4 mm.

11. A burner as claimed in claim 8, wherein the cap is positioned on the burner body by way of three studs.

* * * * *